US006746132B2

(12) United States Patent
Liu

(10) Patent No.: US 6,746,132 B2
(45) Date of Patent: Jun. 8, 2004

(54) NON-INVASIVELY ACTUATED LIGHTED DRINKING VESSEL AND BASE UNIT

(75) Inventor: Ching Liu, Lake Oswego, OR (US)

(73) Assignee: Pacific Cornetta, Inc., Wilsonville, OR (US)

( * ) Notice: Subject to any disclaimer, the term of this patent is extended or adjusted under 35 U.S.C. 154(b) by 0 days.

(21) Appl. No.: 10/205,645

(22) Filed: Jul. 24, 2002

(65) Prior Publication Data

US 2004/0017678 A1 Jan. 29, 2004

(51) Int. Cl.[7] ..... F21V 33/00
(52) U.S. Cl. ..... 362/101; 362/276; 362/802
(58) Field of Search ..... 362/101, 276, 362/802, 253, 394, 295

(56) References Cited

U.S. PATENT DOCUMENTS 6,005,204 A * 12/1999 Choi et al. ..... 362/101
6,416,198 B1 * 7/2002 Vanderschuit ..... 362/101
6,437,703 B1 * 8/2002 Fong ..... 340/689

* cited by examiner

*Primary Examiner*—Thomas M. Sember
(74) *Attorney, Agent, or Firm*—Steven J. Adamson

(57) ABSTRACT

A lighted vessel, container or other item and a base unit for same. The base unit includes a resealable watertight housing that contains a light source. A mechanism is provided that activates and de-activates the light source in a manner that in non-invasive of said housing. This mechanism preferably includes magnetic actuation.

15 Claims, 2 Drawing Sheets

NON-INVASIVELY ACTUATED LIGHTED DRINKING VESSEL AND BASE UNIT

FIELD OF THE INVENTION

The present invention relates to lighted drinking vessels, including cups, thermoses, mugs, glasses, pitchers, and other containers and items. More specifically, the present invention relates to non-invasively activating a light provided with such vessels, containers or items.

BACKGROUND OF THE INVENTION

The prior art includes many examples of lighted drinking vessels and like devices. Examples include, but are not limited to, the devices of U.S. Pat. Nos. 5,575,553; 5,879,068; 6,065,848 and 6,352,352.

The device of U.S. Pat. No. 5,575,553 (issued to Tipton on Nov. 19, 1996, for a Container Using Fiber Optic Imaging) discloses a drinking vessel having an LED light source in the base and a motion sensitive switch for turning the light source on and off. U.S. Pat. No. 5,879,068 (issued to Menashrov on Mar. 9, 1999, for an Illuminated Drinking Vessel) discloses a drinking vessel with a battery power light source that is turned on and off with a mechanical switch.

Motion sensors and similar switches are disadvantageous in that they may be readily turned-on accidentally resulting in unnecessary energy consumption and more frequent battery replacement. This susceptibility to easy turn-on necessitates additional handling steps including careful positioning during use and storage and removal of batteries before dishwashing, etc., to avoid accidental turn-on (see Col. 4, lines 49–51, of U.S. Pat. No. 5,575,553 issued to Tipton).

Referring to mechanical switches, such as those discussed in U.S. Pat. No. 5,879,068 and others, several problems exist with mechanical switches. Depending on a given design, these problems may include that the switches leak during cleaning or use, resulting in unintended conductivity and corrosion; that the mechanical linkages in the switches are prone to failure and that the switches are positioned in such a manner that activation is awkward and risks beverage spilling.

A need thus exists for a lighted container or the like that may be reliably, controllably and economically turned on and off. A need further exists for a noninvasive activation mechanism and a design that provides easy cleaning and fosters activation or de-activation in a manner that is unlikely to result in spillage.

SUMMARY OF THE INVENTION

Accordingly, it is an object of the present invention to provide a lighted drinking vessel or other item in which activation of the light source is readily and reliably controllable.

It is another object of the present invention to provide a light drinking vessel or other item that includes a long-lived, non-invasive activation mechanism.

It is another object of the present invention to provide a lighted drinking vessel or other item that may be readily activated without spilling, but has low susceptibility to accidental turn-on.

It is also an object of the present invention to provide a lighted drinking vessel or other item with a magnetic activation switch.

These and related objects of the present invention are achieved by use of a magnetically activated lighted drinking vessel and base unit as described herein.

In one embodiment, the present invention includes a drinking vessel or other container having a base region and a wall integrally formed with the base region so as to hold a liquid. A light source is provided within said base region and a magnetically actuated switch non-invasively activates and deactivates said light source. The light source may be a light emitting diode or other suitable light and is preferably provided in a resealable watertight housing. The magnetic switch may include a first one of paired materials provided inside the housing and a second one of paired materials provided outside the housing, movement of the paired material relative to one another causing the activation or de-activation of the light source.

In another embodiment, the present invention includes a lighted device having a housing that is releasably sealable and encloses a light source and power supply receptacle. A switch is provided for activating and deactivating said light source that functions in a manner that is non-invasive of said housing. The device preferably includes a liquid receiving chamber capable of receiving and holding liquid.

In yet another embodiment, the present invention includes a lighted base unit. The base unit may include a housing having a resealable watertight seal, a light source and a power supply receptacle provided therein. A magnetically actuated switch is provided for activation or de-activation of the light source.

In yet a further embodiment, the present invention includes a lighted base unit that has a resealable watertight housing containing a light source and a power supply receptacle. An activation member is moveably coupled to said housing and configured such that rotation of said activation member in a substantially horizontal plane achieves activation and de-activation of the light source.

The attainment of the foregoing and related advantages and features of the invention should be more readily apparent to those skilled in the art, after review of the following more detailed description of the invention taken together with the drawings.

DETAILED DESCRIPTION

Figure 1:
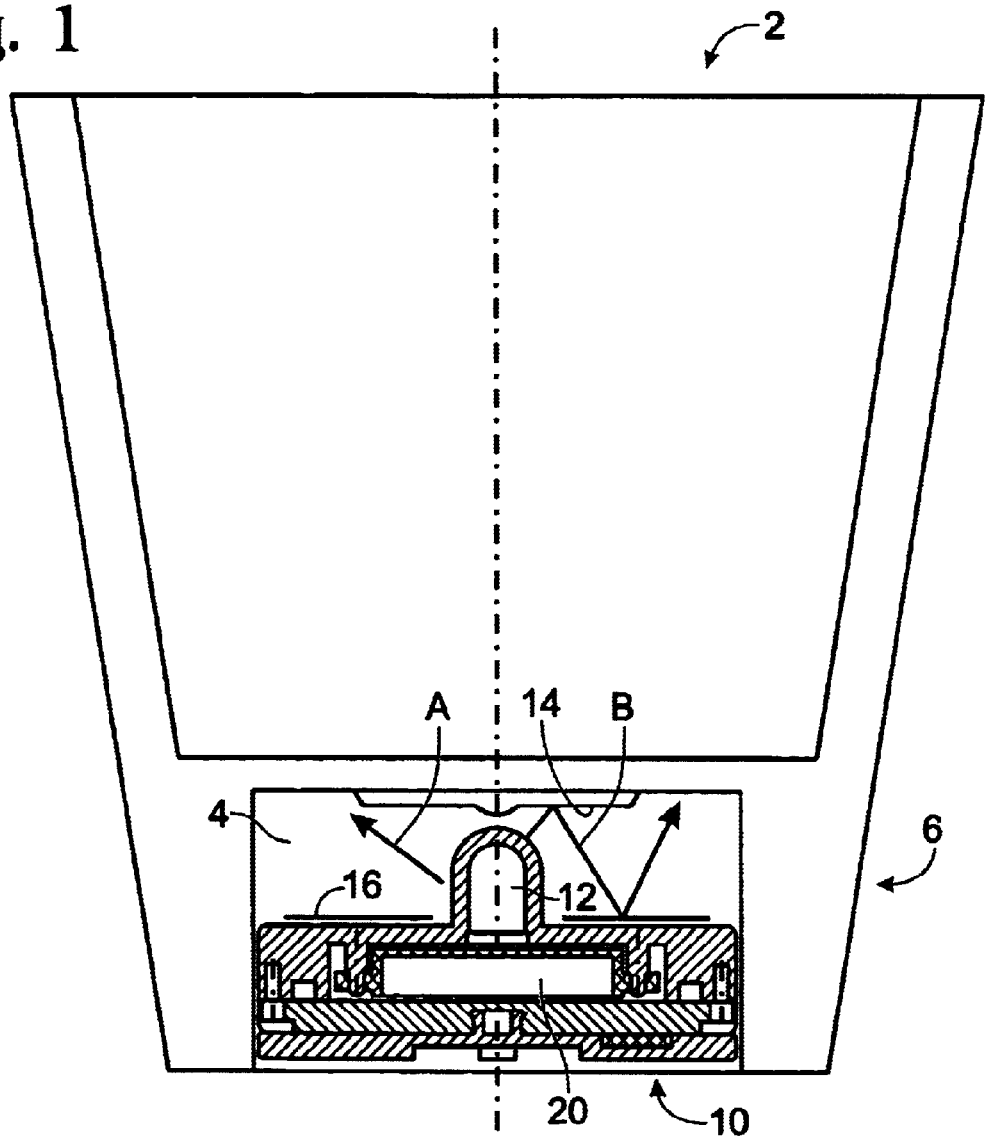
FIG. 1 is a cross-sectional elevation view of a drinking vessel or container in accordance with the present invention.

Referring to FIG. 1, a cross-sectional elevation view of a drinking vessel 2 in accordance with the present invention is shown. Vessel 2 includes a recess 4 in its base 6 in which is provided an illuminated base unit 10. Unit 10 may be fabricated in a number of different arrangements and with different component material without deviating from the present invention. Base unit 10 includes a light source 12 such as an LED or other suitable light source, a power source 20 which may be a battery or other power source, and a mechanism for activating and de-activating light source 12. In the embodiment of FIG. 1, light from LED 12 enters vessel 2 by at least two paths: in path A light travels directly into the vessel and in path B light reflects off a first reflector 14 and a second reflector 16 before entering the vessel.

Figure 3:
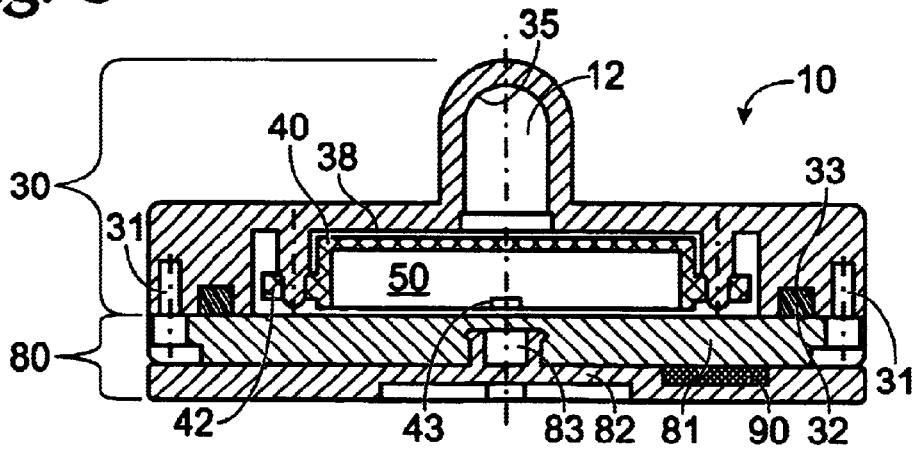
FIGS. 2–3 are a cross-sectional elevation view and a bottom view, respectively, of the base unit of the vessel or container of FIG. 1.
Figure 2:
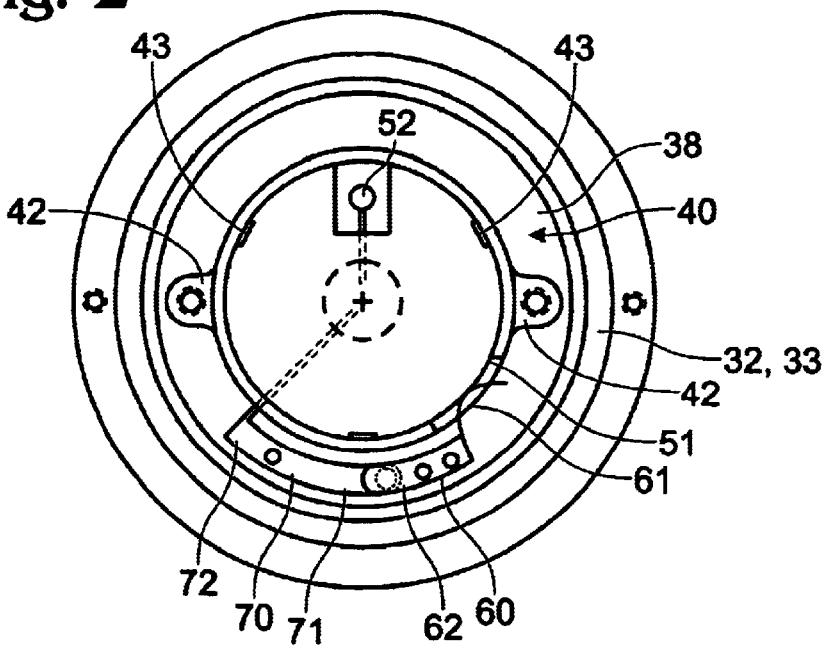

Referring to FIGS. 2–3, base unit 10 of FIG. 1 is shown in more detail. FIG. 2 illustrates a bottom view (without bottom housing 80, see FIG. 3) and FIG. 3 illustrates a cross-sectional side view. Base unit 10 in the embodiment of FIG. 3 is comprised of a top housing 30 and a bottom housing 80. These two housings are maintained in a watertight manner by a plurality of screws 31 and an O-ring 32. The O-ring is provided in circumferential recess 33.

Top housing 30 is preferably made of a translucent plastic or other material that is sufficiently durable and at least in the region of LED 12 passes light. Top housing 30 includes a cavity 35 for LED 12 and a larger interior cavity 38 that contains a battery receiving mechanism 40. The battery receiving mechanism is preferably configured to receive a disc shaped battery 50 (though other battery shapes could be used) and is mounted to housing 30 via members 42. A disc battery 50 inserted into the mechanism and held in place by tabs 43.

FIG. 2 illustrates that in a region of cavity 38 two plate members 60,70 are provided. Plate member 60 is preferably made of brass or like material, and has a first end 61 coupled to a first terminal 51 of battery 50 and a second end 62 provided adjacent to first end 71 of plate member 70. Plate member 70 is preferably made of steel or a like magnetic substance and has a second end 72 that is electrically coupled to one electrode of LED 12. The other electrode of LED 12 is coupled to a second battery terminal 52. Activation and de-activation of LED 12 is achieved by non-invasively moving second end 62 in and out of contact with first end 71 as discussed below.

Bottom housing 80 includes two substantially planar and circular members 81,82 (though other shapes could be used) that are movably coupled to one another by pivot 83. The first member, referred to as the sealing member 81, is coupled to top housing 30 via screws 31 and with O-ring 32 forms the resealable watertight seal about cavity 38. The second member, referred to as switch member 82, includes portions of a switch mechanism for activating and deactivating LED 12.

The switch mechanism preferably includes a magnet 90 that is located approximately the same radial distance from pivot point 83 (the center of the base unit) as the overlapping section of ends 62 and 71. When member 82 is turned such that magnet 90 is aligned with ends 62 and 71, end 71 is moved, via magnetic attraction to magnet 90, into contact with end 62 forming a closed circuit that energizes LED 12. Conversely, mis-alignment of magnet 90 with ends 62,71 permits the ends to separate, thus creating an open circuit and de-activating light 12. Steel member 70 is biased towards an open circuit.

Figure 4:
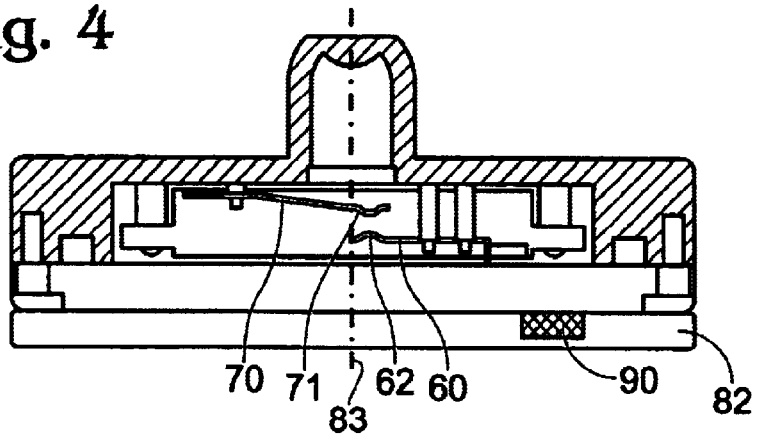
FIGS. 4–5 are elevation views of the base unit of FIGS. 1–3 in the de-activated and activated positions, respectively.
Figure 5:
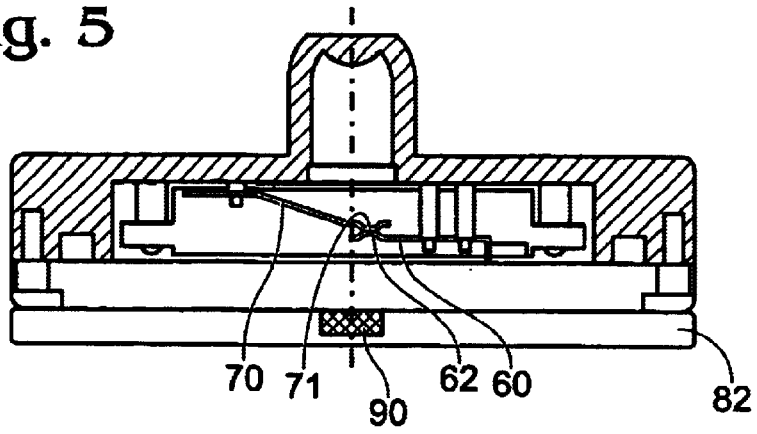

Referring to FIGS. 4–5, "off" and "on" positions of base unit 10 are shown. In FIG. 4, magnet 90 is not aligned with ends 62,71. In FIG. 5, member 82 is rotated approximately ninety degrees from its position in FIG. 4 such that magnet 90 is aligned with the ends 62,71 and causes steel end 71 to be pulled into contact with brass end 62 to form a closed circuit. The base unit (and any illuminated vessel or container that incorporates the base unit) is thus turned-on and off by rotating member 82. If member 82 is provided on the bottom surface of a drinking vessel (or other container or item), then simply rotating the vessel (or container or item) achieves turn-on and turn-off.

To replace a battery or LED, screws 31 are removed and the top and bottom housings separated. To re-establish the watertight seal, O-ring 32 is appropriately positioned and screws 31 retightened. The tension of pivot 83 is preferably set such that switch member 82 does not turn unless intended by a human. As such, base unit 10 or a vessel within which it is provided can be readily placed in a dishwasher or otherwise submerged without leaking or inadvertently activating.

It should be recognized that while magnetic attraction is discussed above, magnetic repulsion could similarly be used to move an end of a contact between activation and de-activation positions.

It should be further recognized that the power supply mechanism may involve solar cells, either directly powering the light source and/or charging batteries coupled to the light source. The solar cells could be positioned on or at the top surface of housing 30 and be charged by ambient light and light emitted by light source 12, amongst other arrangements.

Regarding applicability of the present invention, the present invention includes use in conjunction with any suitable item, be it functional or aesthetic in purpose. Examples include bowls, plates, liquid filled or other displays, coasters, decorative items, etc. The present invention includes both vessels, container and items that include the base unit in addition to the base unit itself.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A lighted drinking vessel, comprising:

a base region;

a wall integrally formed with said base region so as to hold a liquid;

a light source provided within said base region; and a magnetically actuated switch provided within said base region for activating and deactivating said light source;

wherein said base region includes a base unit having a resealable watertight housing; and wherein said magnetically actuated switch includes a first one of paired materials provided inside said housing and a second one of paired materials provided outside said housing.

2. The vessel of claim 1, further comprising a power supply receptacle that receives a power supply, said magnetic switch acting to close and open a conductive path between a power supply in said receptacle and said light source.

3. The vessel of claim 2, wherein said light source and said receptacle are provided in a resealable watertight housing.

4. The vessel of claim 3, wherein said switch operates in a manner non-invasive of said watertight housing.

5. The vessel of claim 1, wherein said light source is a light emitting diode.

6. The vessel of claim 1, wherein said vessel has a primary longitudinal axis and said switch is activated by rotating said vessel in a plane substantially perpendicular to that longitudinal axis.

7. The vessel of claim 1, further comprising an activation member movably coupled to said housing that supports said second one of said paired materials, and wherein movement of said activation member relative to said housing achieves activation or de-activation of said light source depending on the relative position of said first and second paired materials.

8. A lighted device, comprising:

a housing having a releasably sealable watertight seal;

a light source provided in said housing;

a power supply receptacle that receives a power supply for powering said light source; and a switch for activating and de-activating said light source, said switch having an activation member provided external to said housing and functioning in a manner that is non-invasive of said housing;

wherein said switch is magnetically actuated and further wherein said switch has a first one of paired materials provided inside said housing and a second one of paired materials provided outside said housing and coupled to said activation member.

9. The device of claim 8, wherein said device has a primary longitudinal axis and said switch is activated by rotating said device in a plane substantially perpendicular to that longitudinal axis.

10. The device of claim 8, further comprising a liquid receiving chamber capable of receiving and holding liquid.

11. A lighted base unit for use with a liquid holding device, comprising:

a housing having a resealable watertight seal;

a light source provided within said housing;

a power supply receptacle coupled to said light source; and a magnetically actuated switch provided with said housing for activation or de-activation of said light source, said switch including:

a first one of paired magnetic materials provided within said housing; and a second one of paired magnetic materials provided outside of said housing, said second one of paired magnetic materials being moveable in relation to said housing;

wherein movement of said second one of paired magnetic materials relative to said first one of paired magnetic materials causes activation or de-activation of the light source depending on their relative position.

12. The base unit of claim 11, wherein said second one of paired magnetic materials is mounted to said base unit such that said second one moves in a plane that is substantially horizontal when said base unit is in use.

13. The base unit of claim 11, wherein said switch functions in a manner that is non-invasive of said housing.

14. A lighted base unit for use with a drinking vessel, comprising:

a resealable watertight housing that encloses a light source;

a power supply receptacle provided with said housing and coupled to said light source; and a switch for activating and de-activating said light source, said switch having an activation member provided external to said housing, moveably coupled to said housing and functioning in a manner that is non-invasive of said housing;

wherein said base unit has a principal horizontal plane and rotation of said activation member in a plane substantially parallel with said principal horizontal plane achieves activation and de-activation of said light source.

15. The device of claim 14, further comprising a liquid receiving chamber extending upward from said housing and capable of receiving and holding liquid.

* * * * *